US005643101A

United States Patent [19]

Foley

[11] Patent Number: 5,643,101

[45] Date of Patent: Jul. 1, 1997

[54] GOLF PUTTER

[76] Inventor: Newman C. Foley, 422 Meredith Rd., Albert Lea, Minn. 56007

[21] Appl. No.: 623,033

[22] Filed: Mar. 28, 1996

[51] Int. Cl.[6] ..... A63B 53/04; A63B 69/36

[52] U.S. Cl. ..... 473/251; 473/254; 473/255; 473/328; 473/349

[58] Field of Search ..... 473/251, 252, 473/253, 254, 255, 328, 349

[56] References Cited

U.S. PATENT DOCUMENTS

| | | | |
|---|---|---|---|
| 179,590 | 1/1876 | Carper . | |
| 213,118 | 1/1879 | Locke . | |
| 248,050 | 5/1881 | Miller . | |
| 837,030 | 11/1906 | Blanchard . | |
| 3,955,819 | 5/1976 | Yokich . | |
| 4,141,556 | 2/1979 | Paulin . | |
| 4,383,690 | 5/1983 | Maxwell . | |
| 4,390,184 | 6/1983 | Rudell | 473/253 |
| 4,834,387 | 5/1989 | Waites et al. | 473/252 |
| 4,988,107 | 1/1991 | Sasse . | |

FOREIGN PATENT DOCUMENTS

| | | |
|---|---|---|
| 465643 | 5/1937 | United Kingdom . |

OTHER PUBLICATIONS

Golf Digest, Aug. 1961 p. 68.

*Primary Examiner*—George J. Marlo
*Attorney, Agent, or Firm*—Lowe, Price, LeBlanc & Becker

[57] ABSTRACT

A golf putter includes a sighting line formed by the intersection of two faces, a narrow bottom surface and a striking face having a cut out portion therein. The intersection of the two faces improves sighting for putting stroke with the narrow bottom and striking face cutout permitting putting in heavy grass conditions. The putter also has a curved bottom which permits making both a hit-down stroke and a lofting stroke and means for adjusting the overall weight thereof.

5 Claims, 5 Drawing Sheets

GOLF PUTTER

TECHNICAL FIELD

The present invention is directed to a golf putter and, in particular, a golf putter providing improved sighting and flexibility in putting strokes and varying grass conditions.

BACKGROUND ART

In the prior art, various putter designs have been proposed to improve a golfer's game.

In U.S. Pat. No. 837,030 to Blanchard, a golf putter is disclosed which has a ridge which is perpendicular to the plane of a striking face thereof. The ridge is substantially over the striking center which is intended to strike the ball on delivery of the stroke, so that as the player places and swings the club, he may sight along the ridge and guide the club to stroke the ball.

U.S. Pat. No. 3,955,819 to Yokich discloses a golf putter with a distinctive sighting aid that maintains balance of the club. The golf putter includes a series of lands and grooves on the bottom thereof wherein the grooves have a sloping characteristic that are deeper near the face of the club to provide an upward pressure when the club strikes the ground.

U.S. Pat. No. 4,141,556 to Paulin discloses a golf putter having a head of generally triangular shape in plan view and a substantially vertical striking surface. The upper surface is provided with an alignment groove.

One of the problems in prior art putter designs is the inability to both hit down on a golf ball or loft it up with a single club. The prior art designs also make it difficult to putt in tall or medium length grass, accurately align the putter with a ball or provide putter head weight adjustability.

Accordingly, a need has developed to provide a putter overcoming the deficiencies noted above. In response to this need, the present invention provides a golf putter which offers improved sighting to a golfer, flexibility in achieving different putting strokes, particularly in varying grass conditions, and weight adjustability.

SUMMARY OF THE INVENTION

Accordingly, it is a first object of the present invention to provide an improved golf putter.

Another object of the present invention is to provide a golf putter capable of being swung through heavy grass with minimum stroke interference.

A still further object of the present invention is to provide a golf putter having a putter head shape which permits a golfer to both hit down on a golf ball or loft a golf ball with the same putter head.

Another object of the present invention is to provide a golf putter design which offers a golfer improved alignment between the putter head and golf ball as well as weight adjustability.

Other objects and advantages of the present invention will become apparent as a description thereof proceeds.

In satisfaction of the foregoing objects and advantages, the present invention provides a golf putter having a shaft and a putter body connected to the shaft. The putter body includes a striking face and a sighting line perpendicular to the striking face, the sighting line formed by the intersection of first and second faces, the first face being in a plane generally parallel to an axis of the shaft, the second face being in a plane generally perpendicular to the striking face.

The putter body also has a bottom face extending from a rear of the putter body to the striking face, the bottom face curved in shape to facilitate moving the putter body through heavy grass and accommodate different putting strokes.

The putter body may also include a sighting protrusion extending generally perpendicularly from the striking face, the sighting protrusion having a face in the same plane as the first face.

In another aspect of the invention, the body head can include means for adjusting the overall weight of the head. In this embodiment, the putter head can include a hollow bore which receives one or more weights for putter head weight adjustment.

BRIEF DESCRIPTION OF DRAWINGS

Reference is now made to the drawings of the invention wherein.

DESCRIPTION OF THE PREFERRED EMBODIMENTS

Figure 1:
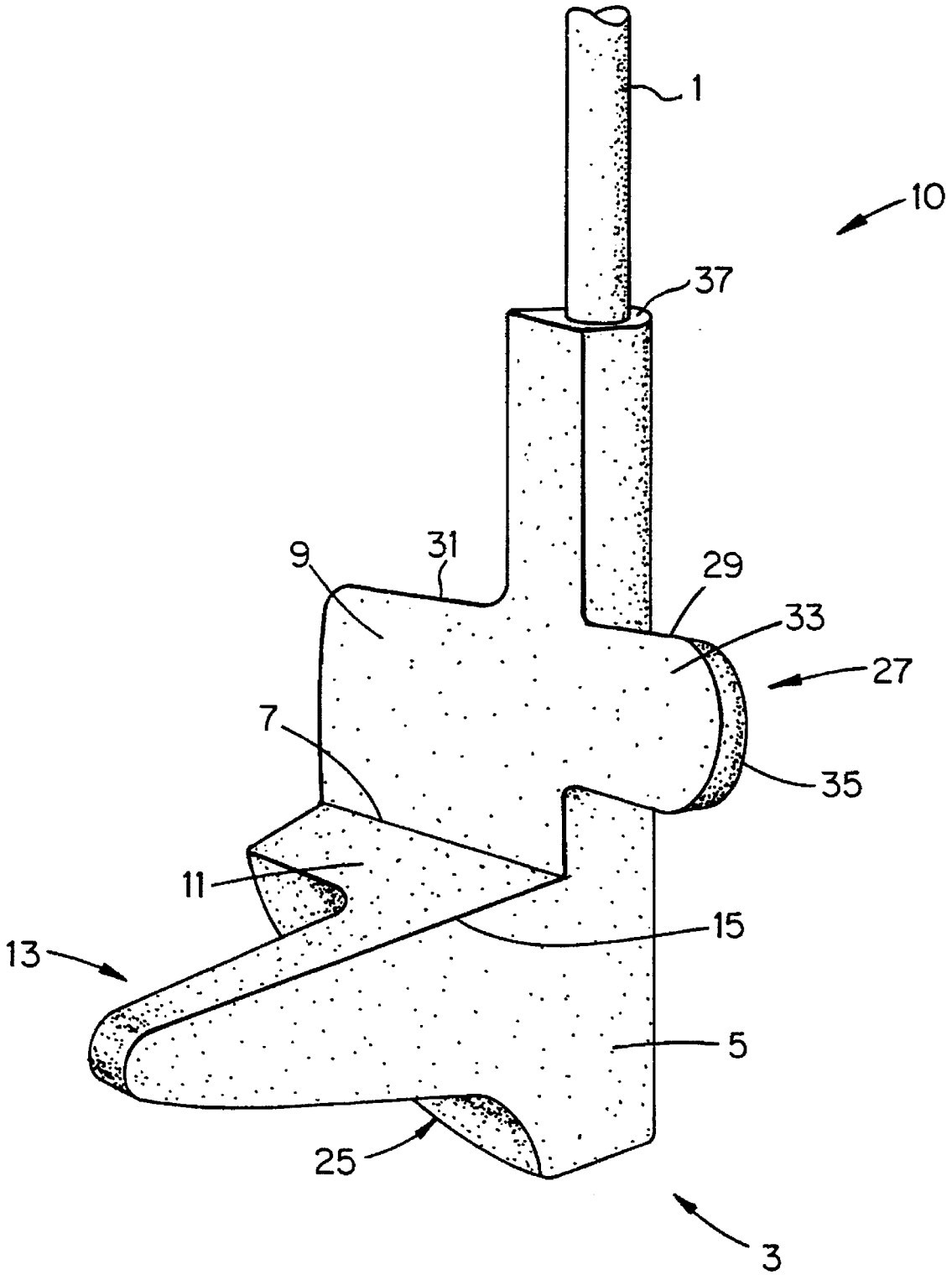
FIG. 1 is a front perspective of a first embodiment of the inventive golf putter.
Figure 2:
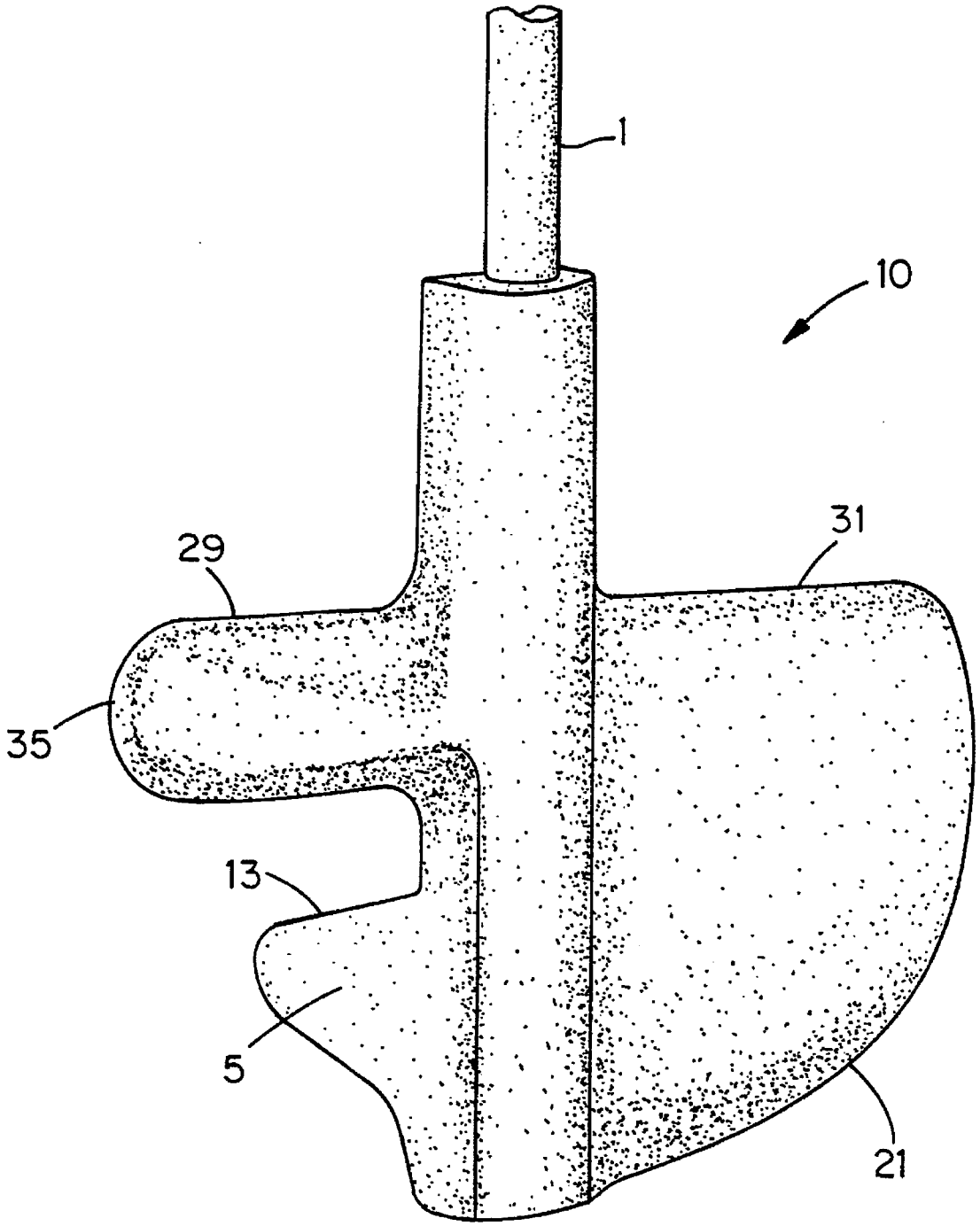
FIG. 2 is a rear perspective view of the first embodiment.
Figure 3:
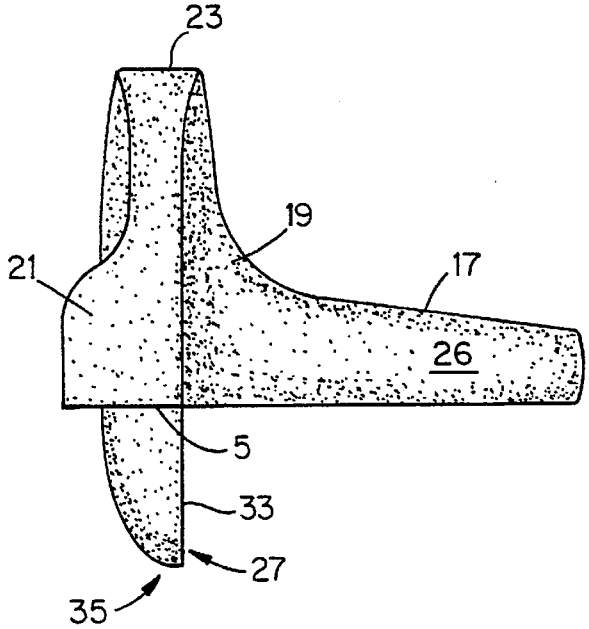
FIG. 3 is a bottom view of the first embodiment.

With reference now to FIGS. 1–3, a first embodiment of the inventive golf putter is generally designated by the reference numeral 10 and is seen to include a shaft 1 and a putter body 3.

The putter body 3 has a striking face 5 and a sighting line 7. The sighting line 7 is formed by the intersection of a first face 9 and a second face 11.

The putter body 3 also has a protrusion 13, a front face thereof forming part of the striking face 5.

A leading edge 15 is formed at the intersection of the striking face 5 and combination of the second face 11 and top surface of the protrusion 13. The leading edge 15 assists in aligning the putter with a golf ball for stroking.

The protrusion 13 includes a rear face which joins the putter body at reference numeral 19, see FIG. 3.

The putter body 3 also includes a curved bottom 21 which extends from a rearward portion 23 of the putter body to the striking face 5 (FIG. 3). The narrow width of the curved bottom 21 assists in stroking of the putter as described below.

The configuration of the protrusion 13 forms a hollow 25 between the protrusion lower face 26 and a ground surface. This hollow assists in putting in heavy grass conditions as described above.

The embodiment of FIGS. 1–3 also includes a sighting protrusion 27 having an upper edge 29 in alignment with the upper edge 31 of the first face 9. The sighting protrusion 27 also has a face 33 which is coincident with the first face 9. The sighting protrusion 27 includes a rounded terminal end 35. By reason of its alignment with the first face 9 and sighting line 7, the sighting protrusion effectively elongates the sighting line over the ball for improved putting.

The putter body 3 also includes a junction 37 where the shaft 1 can be attached to the putter body in any conventional fashion. Preferably, the junction 37 includes a hollow in the putter body which is sized to receive the shaft 1.

Figure 4A:
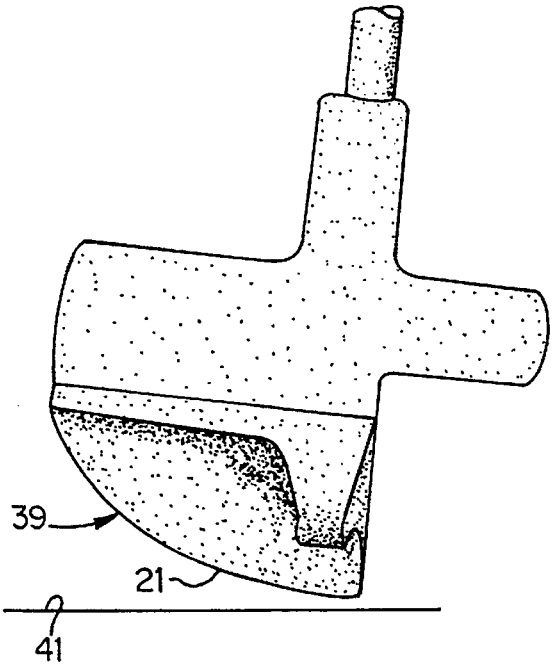
FIGS. 4*a* and 4*b* show different strokes using the putter of FIG. 1.
Figure 4B:
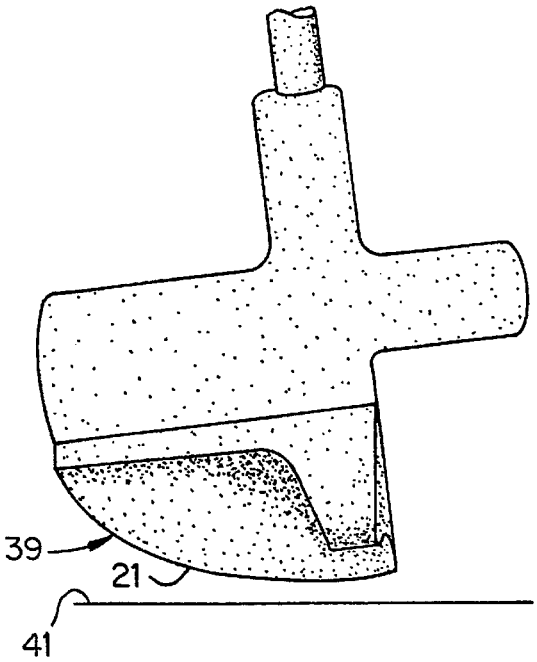

Referring now to FIGS. 4*a* and 4*b*, the versatility of the golf putter 10 is demonstrated. More specifically, the bottom face 21 has a curve depicted by reference numeral 39. This curve permits a golfer to use a hit-down stroke, FIG. 4*a*, and a lofting stroke, FIG. 4*b*, without the ground interfering with the bottom 21 of the putter body. As shown in FIG. 4*b*, the putter can be tilted away from a golf ball to be stroked without the curve 39 being obstructed by a ground surface 41. With this configuration, the inventive putter 10 can be used for both types of strokes.

Figure 5:
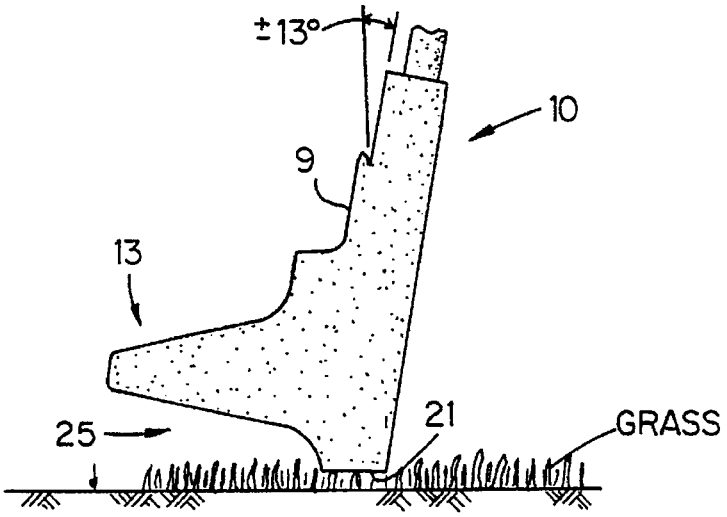
FIG. 5 depicts an exemplary use of the putter of the first embodiment in tall grass.

FIG. 5 shows the usefulness of the inventive putter in tall grass. The combination of the protrusion which forms the hollow 25 and the narrow bottom 21 of the putter permit the putter to travel through high grass without excessive interference. Only the narrow bottom surface 21 engages the grass rather than the entire bottom surface of the putter body.

FIG. 5 also shows an exemplary angle between vertical and the first face 9. Although 13° is depicted, other angulations can be used providing that the sighting line 7 can still be viewed by the golfer. It is believed that an angle between 10° and up to 25° from vertical is most acceptable.

Figure 6:
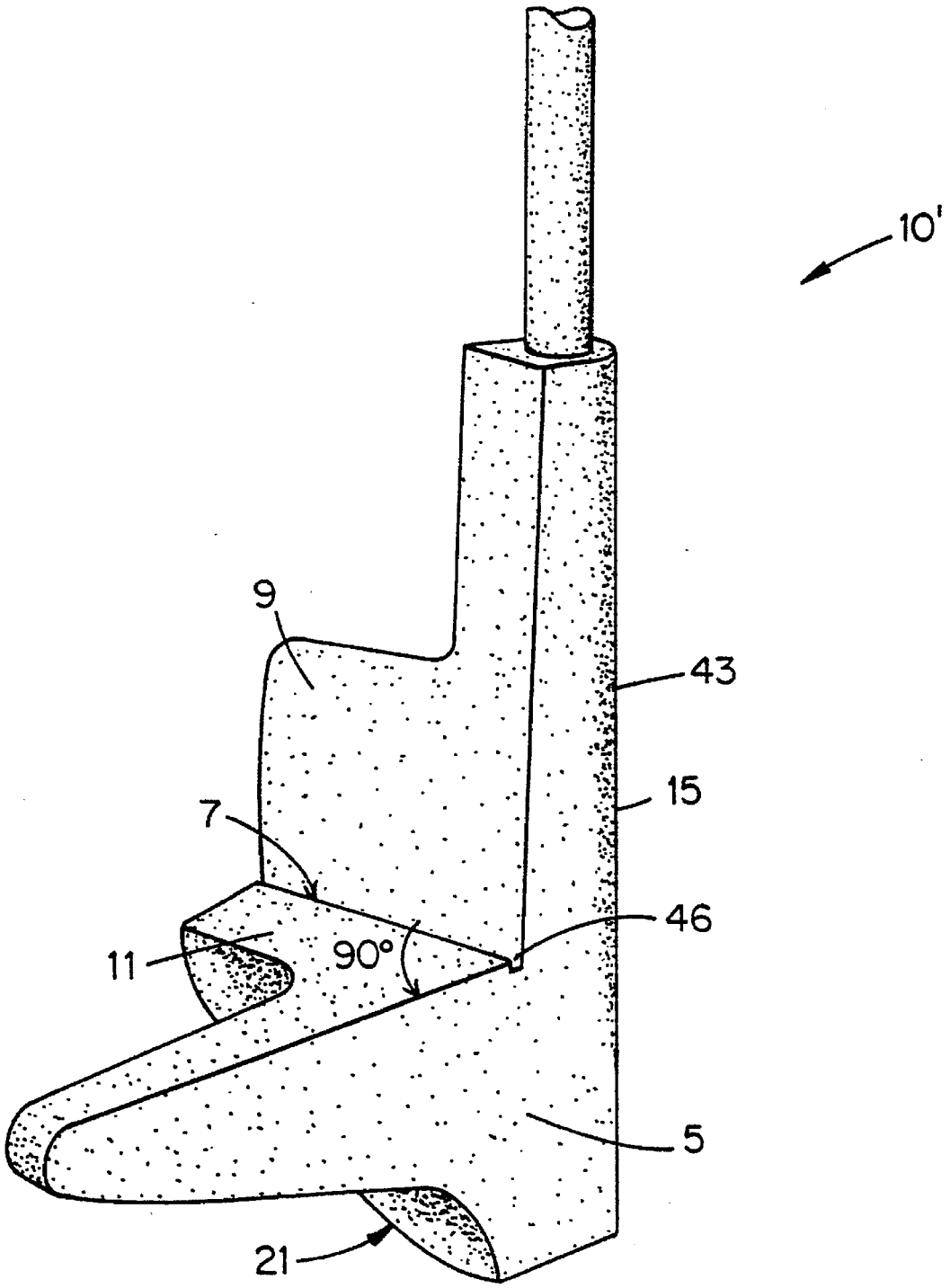
FIG. 6 is a front perspective view of a second embodiment.

FIG. 6 depicts an alternative embodiment of the invention designated by the reference numeral 10'. In this embodiment, the sighting protrusion 27 is removed from the putter body to provide a face 43 which is coincident with the striking face 5. The sighting line 7 is shown as a groove 46 in the face 11. This embodiment provides all the advantages described above with respect to the first embodiment of the invention except for additional sighting through the use of the sighting protrusion 27.

Figure 7:
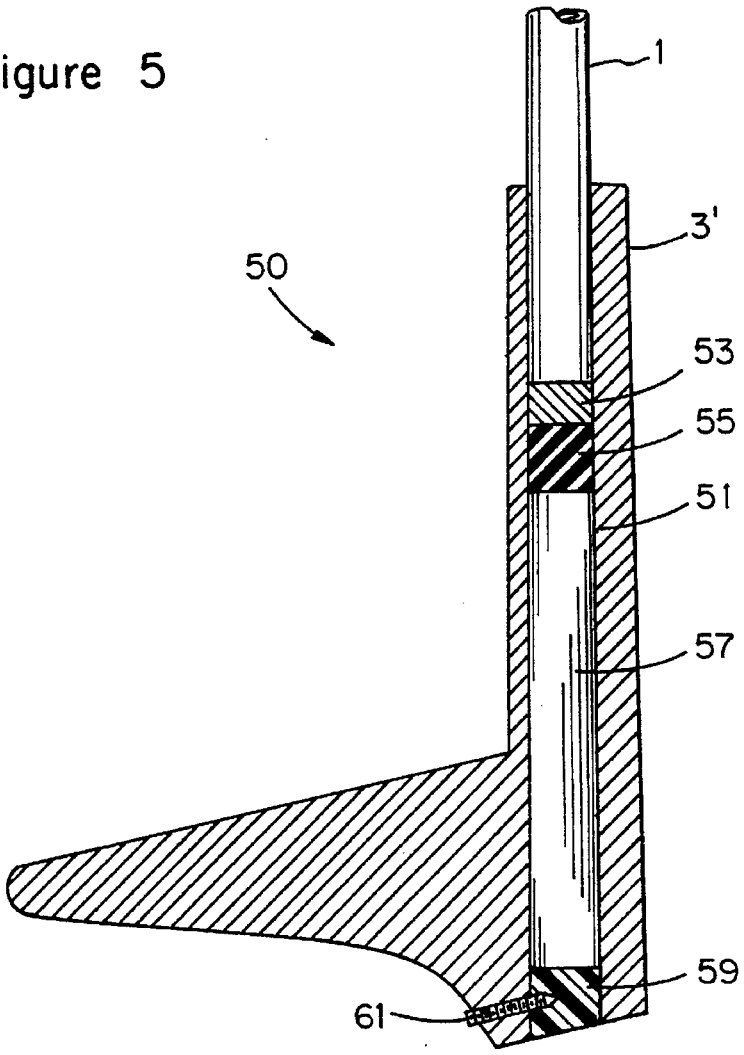
FIG. 7 is a sectional view of a third embodiment of the invention showing weight adjustability.

FIG. 7 shows a third embodiment of the invention which includes means for adjusting the weight of the putter body 3. In this embodiment, generally designated by the reference numeral 50, the putter body 3' has a bore 51 therethrough. The shaft 1 is inserted into one end of the bore and secured in any conventional fashion. Adjacent the shaft 1 is a plug 53 which acts as a stop for shaft insertion. The plug 53 also acts as a divider between the shaft and the weight adjusting means described below.

The weight adjusting means comprises a cushion 55, one or more weights 57 and an end plug 59. The cushion 55 separates the weight 57 from the plug 53. The end plug 59 secures the weight 57 in the bore 51. The end plug 59 can be secured in any conventional fashion, one example being a set screw 61 as shown in FIG. 7.

The weight 57 may be cylindrical in shape and constitute a single weight or may comprise a plurality of cylinders of the same or varying mass. Thus, a golfer may adjust the overall weight of the putter head by varying the number and/or type of weights disposed in the bore 51.

In FIG. 7, the axis of the shaft 1 is in alignment with the weight 57, this arrangement providing balance to the putter head. Of course, the bore may be positioned elsewhere in the putter body and the weights may be inserted therein without the need for a separation from the shaft.

As such, an invention has been disclosed in terms of preferred embodiments thereof which fulfill each and every one of the objects of the present invention as set forth hereinabove and provides a new and improved golf putter.

Of course, various changes, modifications and alterations from the teachings of the present invention may be contemplated by those skilled in the art without departing from the intended spirit and scope thereof. Accordingly, it is intended that the present invention only be limited by the terms of the appended claims.

I claim:

1. A golf putter comprising:

a) a shaft; and b) a putter head having an upper and a lower portion, the upper portion including a hosel connecting said shaft to the upper portion, an axis of said shaft intersecting each of said upper and lower portions;

c) the upper portion further comprising a planar upper front face and a planar side face, each of the planar upper front face and the planar side face aligned with the axis of the shaft;

d) the lower portion disposed beneath said upper portion, the lower portion including;

i) a curved bottom face, a planar top face which intersects the planar side face of the upper portion to form a sighting line and a planar lower front face; and e) an elongated portion extending from said lower portion, the elongated portion having an upper top face coincident with the planar top face of the lower portion and a forward face coincident with the planar lower front face of the lower portion, the planar lower front face, the planar upper front face and the forward face being in the same plane and being forward of the axis of the shaft for golf ball contact, the planar lower front face and the forward face sized to form a striking face, a center portion thereof aligned with the sighting line.

2. The golf putter of claim 1, wherein the planar side face and the planar top face form at least a 103° angle.

3. The golf putter of claim 1, wherein the sighting line is perpendicular to the striking face.

4. The golf putter of claim 1, wherein the elongated portion has a curved bottom extending from a distal end of the elongated portion to the lower portion bottom face, the curved bottom forming a hollow when the lower portion rests on a surface to permit said putter head to travel through tall grass during stroking of the golf putter.

5. The golf putter of claim 1, wherein the sighting line further comprises a groove at the intersection of the planar side face and the planar top face.

* * * * *